United States Patent [19]

Goeke

[11] 3,981,404

[45] Sept. 21, 1976

[54] TELESCOPING GARMENT HANGER

[76] Inventor: John C. Goeke, 161 SW. 18th St., Richmond, Ind. 47374

[22] Filed: Jan. 20, 1975

[21] Appl. No.: 542,234

[52] U.S. Cl. ..... 211/1.3; 211/105.3

[51] Int. Cl.[2] ..... A47H 1/08

[58] Field of Search ..... 211/1.3, 94, 94.5, 105.3, 211/123; 248/251, 221, 252, 257; 312/21, 131, 132

[56] References Cited

UNITED STATES PATENTS

| | | | |
|---|---|---|---|
| 2,202,811 | 6/1940 | Carney et al. | 211/1.3 X |
| 2,230,793 | 2/1941 | Borah | 312/177 |
| 2,355,835 | 8/1944 | Whalen | 211/1.3 X |
| 2,587,111 | 2/1952 | Cashen, Jr. | 211/1.3 |
| 3,527,352 | 9/1970 | DeLapa | 211/1.3 |

FOREIGN PATENTS OR APPLICATIONS

| | | | |
|---|---|---|---|
| 21,157 | 12/1893 | United Kingdom | 211/1.3 |

*Primary Examiner*—Roy D. Frazier
*Assistant Examiner*—Terrell P. Lewis
*Attorney, Agent, or Firm*—Woodard, Weikart, Emhardt & Naughton

[57] ABSTRACT

A telescoping garment hanger which is mountable to most walls and doorways found in standard utility rooms and the like. A first tubular member of generally circular cross sectional area is mounted to one or more studs in the wall of a building. A mounting bracket is secured to one end of the first tubular member and is in turn secured to the supporting structure. A second tubular member is telescopically received by the first tubular member and has a pull knob attached to one end to prevent hangers and other hanging objects from sliding off during periods of use. In addition, the second tubular member has one or more rings attached to the end opposite the pull knob to prevent angular displacement during actual use and to prevent the tubular members from disengaging.

1 Claim, 5 Drawing Figures

TELESCOPING GARMENT HANGER

BACKGROUND OF THE INVENTION

1. Field of the Invention

This invention relates to telescoping garment hangers and more particularly wall mountable telescoping garment hangers.

2. Description of the Prior Art

Garment hangers of various shapes and designs have been known and used for many years. They range in size from the typical hanger rod found in most closets to the specialized garment hangers used in tailor shops and the like. All of these garment hangers suffer from a common shortcoming in that they are unattractively visible even during periods of non-use. As most garment hangers are primarily functional as opposed to being aesthetically pleasing, it is the desire of most persons to keep garment hangers out of sight in homes and the like but at the same time to retain maximum utility from the garment hangers by having them close at hand. The garment hanger of this invention satisfys this need in that it is completely enclosed within a wall space and is not particularly visible with the single exception of a decorative cap which is used to pull the hanging rod from its retracted position.

Summary of the Invention

This invention relates to a telescoping garment hanger which comprises a first tubular member having an exterior end and an interior end. Mounting means are attached to the exterior end of the first tubular member. A second member is telescopically received by the first tubular member, with the second member also having an exterior end and an interior end. Alignment means are attached to the interior end of the second member with the alignment means including means adapted to prevent the second member from disengaging from the first tubular member and also including means adapted to prevent angular displacement of the axis of the second member relative to the axis of the first tubular member when the second member is in the extended position. Stop means are attached to the exterior end of the second member to prevent objects such as hangers on the second member from sliding off the second member during periods of use when it is in the extended position.

It is an object of this invention to provide a garment hanger which during periods of non-use can be substantially hidden from view.

It is a further object of this invention to provide a garment hanger which is telescoped so as to provide a variety of extended and retracted positions.

It is a still further object of this invention to provide a telescoping garment hanger wherein there is substantially no angular displacement of the hanging member during use.

It is an additional object of this invention to provide a garment hanger which is mountable within the wall of most standard utility rooms and the like.

These and other objects of this invention will become apparent from the following description of the preferred embodiment.

DESCRIPTION OF THE PREFERRED EMBODIMENT

Figure 1:
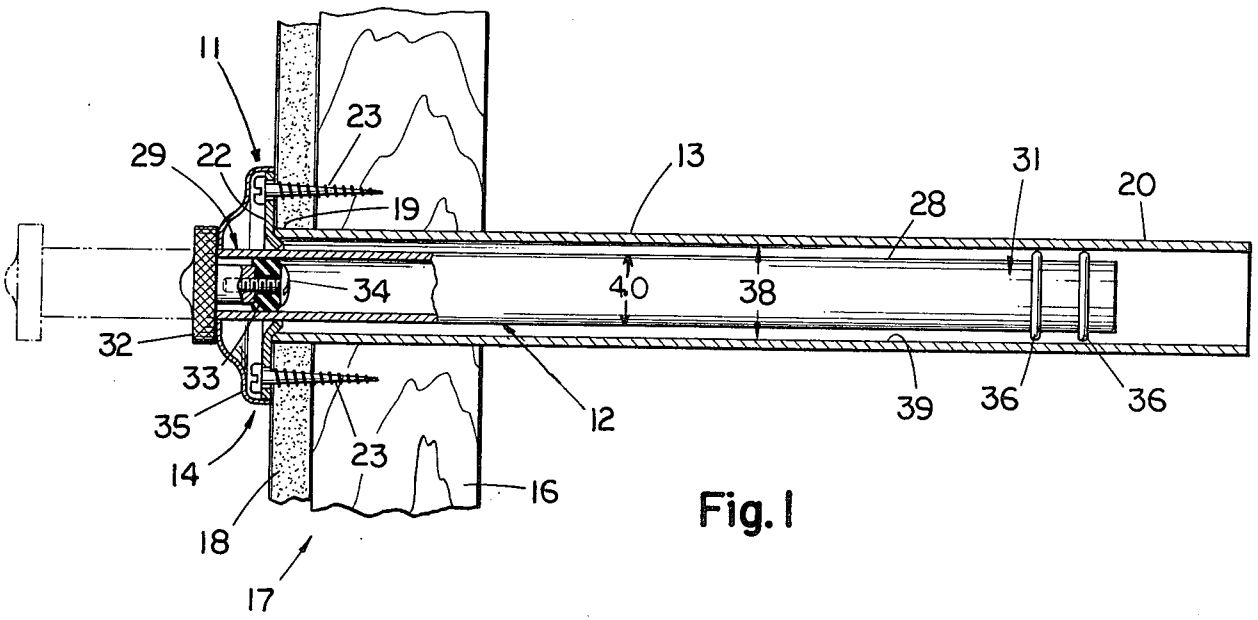
FIG. 1 is a side view partially in section of the garment hanger assembly mounted in a wall in the retracted position.
Figure 2:
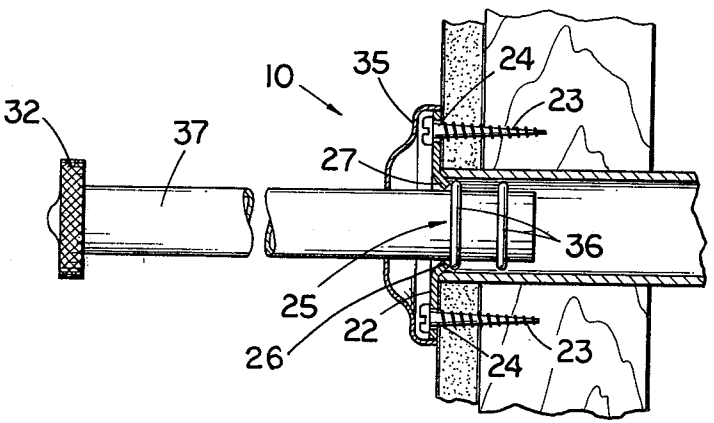
FIG. 2 is a view similar to that of FIG. 1 with the exceptions that the garment hanger assembly is in the extended position and only the mounting assembly is in section.
Figure 4:
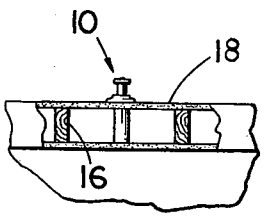
FIG. 4 is a top view partially in section showing the garment hanger assembly mounted in a wall without intersecting any studs.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, the garment hanger assembly 10 comprises a mounting assembly 11 and a hanging assembly 12. Hanging assembly 12 is telescopically received by mounting assembly 11 and permits hanging assembly 12 to be extended during periods of use and to be retracted into mounting assembly 11 during periods of non-use.

Mounting assembly 11 comprises a tubular member 13 to which mounting means 14 are attached. Tubular member 13 is preferably made from ¾ inch diameter conduit having a circular cross sectional area. Although the size of tubular member 13, either in terms of diameter or length, is not critical some practical considerations are generally observed for purposes of ease of mounting.

Figure 5:
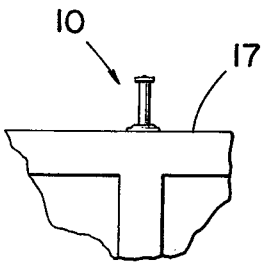
FIG. 5 is a top view showing the garment hanger assembly mounted at the intersection of two walls.
Figure 3:
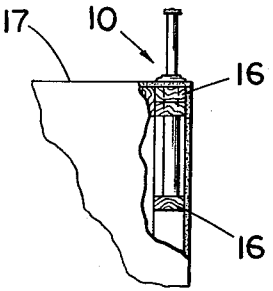
FIG. 3 is a top view partially in section showing the garment hanger assembly mounted in a doorway.

The garment hanger assembly 10 is designed to be mounted in a vertical wall such as would normally be found in households, in utility rooms, closets and the like. Therefore, a variety of mounting positions are possible. As is shown in FIG. 3, when the assembly 10 is mounted in the doorway portion of a wall 17 the tubular member 13 may theoretically be as long as the wall 17 and can be inserted through openings in the studs 16 in the wall 17. In the alternative, the garment hanger assembly 10 may be inserted at the intersection of two walls as shown by FIG. 5 again allowing the theoretical length of tubular member 13 to be the entire length of the wall 17 and not requiring a doorway. A third alternative mounting position is the mounting of a very short garment hanger assembly 10 and tubular member 13 in the wallboard 18 without the necessity of intersecting any studs 16. For most purposes, the length of tubular member 13 is preferably from about 10 inches to about 20 inches while for the mounting of the shorter version as in the third alternative supra the length of tubular member 13 should be approximately 3 to 4 inches. However, as stated previously neither the diameter or length of tubular member 13 are critical and may be varied according to the individual user or manufacturer.

Mounting means 14 are attached to the exterior end portion 19 of tubular member 13. The interior end portion 20 of tubular member 13 is generally contained within the wall or other structure on which the garment hanger assembly 10 is mounted. A keeper plate 22 is mounted to the exterior end portion 19 of tubular member 13. Keeper plate 22 is in turn mounted to wall board 18 and/or studs 16 by means of wood screws 23. The size and shape of keeper plate 22 may be varied depending upon the individual desires of the user or manufacturer. Keeper plate 22 has in addition to openings 24 for wood screws 23 an indented opening 25 through which hanging assembly 12 protrudes. The edge 26 of opening 25 is indented to form a retainer portion 27 which services as a stop means to prevent disengagement of the hanging assembly 12 from the mounting assembly 11.

Hanging assembly 12 comprises a tubular member 28 which is smaller in diameter than tubular member 13. Tubular member 28 is preferably made from ½ inch diameter conduit having a circular cross sectional area. As with tubular member 13 the size, either in terms of diameter or length of tubular member 28, is not critical although some practical considerations are generally observed for purposes of ease of mounting and additionally ease of extension and retraction. Preferably, tubular members 13 and 28 are approximately the same length although again this is not critical. As with tubular member 13, tubular member 28 has an exterior end portion 29 and an interior end portion 31. A pull knob 32 is attached to the exterior end portion 29 of tubular member 28. The pull knob 32 serves the dual purposes of both providing a convenient object for the hand or fingers to grasp when extending or retracting tubular member 28 and additionally provides an end piece to prevent hangers and the like from slipping off the end of tubular member 28 while in use. Pull knob 32 is attached to the exterior end portion 29 of tubular member 28 by means of an expansion member 33 and a pull knob screw 34. A decorative cover 35 is preferably provided to conceal wood screws 23. However, decorative cover 35 is essential only to the appearance of the garment hanger assembly 10 and not to the utility of assembly 10. In the alternative, pull knob 32 may be made as decorative as the individual user or manufacturer desires.

Two ring members 36 surround the outer surface 37 of tubular member 28. Ring members 36 are located near the interior end portion 31 of tubular member 28. Ring members 36 function to expand the diameter of tubular member 28 until it is approximately equal to the inside diameter 38 of tubular member 13. The ring members 36 are sized such that a sliding relationship may be obtained between tubular members 13 and 28. The use of a lubricant on the inside surface 39 of tubular member 13 is generally considered desirable. The ring members 36 may either by welded material attached to the outer surface 37 of tubular member 28 or may be rubber rings fixedly attached to said outer surface 37, or other material of suitable size and strength.

In operation, it is preferable to assemble the entire apparatus prior to mounting in the wall 17. In this fashion, the exterior end portion 29 of tubular member 28 is first inserted through the interior end portion 20 of tubular member 13, and then pushed through the exterior end portion 19 of tubular member 13. At this time, the exterior end portion 29 of tubular member 28 is inserted through the opening 25 in keeper plate 22 which substantially corresponds to the outside diameter 40 of tubular member 28 and then pull knob 32 is attached to the exterior end portion 29 of tubular member 28. The entire assembly is then inserted and mounted in the wall 17, as previously described. Using this method of assembly in mounting, the tubular members 13 and 28 are not disengageable as the extension of tubular member 28 to its furthest protracted position will result in the engagement of ring members 36 by the retainer portion 27 of the opening 25. In this fashion, ring members 36 prevent both the disengagement of tubular members 13 and 28 and also prevents angular displacement of the longitudinal axis of tubular member 13 from the longitudinal axis of tubular member 28.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A telescoping garment hanger comprising:

a. a first tubular member having an exterior end and an interior end;

b. a second member having an exterior end and an interior end, said second member being telescopically received by said first tubular member;

c. mounting means near the exterior end of said first tubular member for mounting said first tubular member in a structure;

d. alignment means on said second member near the interior end of said second member for preventing said second member from disengaging from said first tubular member and for preventing angular displacement of the axis of said second member relative to the axis of said first tubular member when said second member has been extended from said first tubular member;

e. stop means near the exterior end of said second member for preventing objects hanging on said second member from sliding off said second member when it has been extended from within said first tubular member; and f. attachment means for removably attaching the stop means to the second member, the perimeter of the cross section of the second member being essentially uniform from the location of the alignment means to the exterior end of the second member and the first tubular member having an inner wall whose cross section is essentially uniform from an area near the mounting means to the interior end of said first tubular member, said attachment means including an expansion member mounted within said second member and a screw whose threaded portion extends through the expansion member and is threadedly received within the stop means, increasing the engagement of the screw within the stop means expanding the diameter of the expansion member thereby retaining the stop means near the exterior end of the second member, whereby adjustment of the overall length of the telescoping garment hanger may be made prior to installation by removing a portion of the interior end of the first tubular member and by removing a portion of the exterior end of the second member before attachment of the stop means to the second member.

* * * * *